US010273753B2

(12) United States Patent
Marland et al.

(10) Patent No.: US 10,273,753 B2
(45) Date of Patent: Apr. 30, 2019

(54) INDEPENDENT MODIFICATION OF DRILL STRING PORTION ROTATIONAL SPEED

(71) Applicant: Halliburton Energy Services, Inc., Houston, TX (US)

(72) Inventors: Christopher Neil Marland, Spring, TX (US); Mark Anthony Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 631 days.

(21) Appl. No.: 14/785,146

(22) PCT Filed: Dec. 23, 2013

(86) PCT No.: PCT/US2013/077460

§ 371 (c)(1),
(2) Date: Oct. 16, 2015

(87) PCT Pub. No.: WO2015/099655

PCT Pub. Date: Jul. 2, 2015

(65) Prior Publication Data

US 2016/0084006 A1 Mar. 24, 2016

(51) Int. Cl.
*E21B 3/02* (2006.01)
*E21B 4/00* (2006.01)
(Continued)

(52) U.S. Cl.
CPC ..... *E21B 7/00* (2013.01); *E21B 3/02* (2013.01); *E21B 4/006* (2013.01); *E21B 17/00* (2013.01); *E21B 17/04* (2013.01)

(58) Field of Classification Search
CPC ... E21B 3/02; E21B 4/006; E21B 4/02; E21B 7/00; E21B 17/00; E21B 17/04
See application file for complete search history.

(56) References Cited

U.S. PATENT DOCUMENTS 2,937,008 A 5/1960 Whittle
3,232,362 A * 2/1966 Cullen ..... E21B 4/00 173/146
(Continued)

FOREIGN PATENT DOCUMENTS

RU 2329376 C2 7/2008
RU 2443844 C2 2/2012
(Continued)

OTHER PUBLICATIONS

"High-torque gear reducer expands turbodrill capabilities", [online]. Oil & Gas Journal. [retrieved on Nov. 6, 2012]. Retrieved from the Internet: <URL: http://www.ogj.com/articles/print/volume-97/issue-27/in-this-issue/drilling/high-torque-gear-reducer-expands-turbodrill-capabilities.html, (Jul. 5, 1999), 9 pgs.
(Continued)

*Primary Examiner* — Matthew R Buck
(74) *Attorney, Agent, or Firm* — Chamberlain Hrdlicka

(57) ABSTRACT

A method of operating a drill string comprises independently modifying a rotary speed of a downhole portion of the drill string relative to other downhole portions of the drill string, each of the portions comprising a plurality of drill pipe sections. The modified-speed portion of the drill string can comprise a downhole end portion of the drill string extending between a downhole drill string end and a curved portion of the borehole in which the drill string is located. The downhole end portion can be rotated at an increased speed relative to a portion of the drill string coincident with the curved portion of the borehole. Independent speed modification can be effected by incorporating one or more transmission modifier devices in the drill string, the transmission modifier device being switchable between a disengaged mode in which it transfers unmodified drill string torque and rotation, and an engaged mode in which it transmits torque and rotation along the drill string at a modified speed and
(Continued)

torque. Selective switching of the transmission modifier devices, while downhole, maybe controlled from the surface.

22 Claims, 7 Drawing Sheets

(51) Int. Cl.

| | |
|---|---|
| ***E21B 7/00*** | (2006.01) |
| ***E21B 17/00*** | (2006.01) |
| ***E21B 17/04*** | (2006.01) |

(56) References Cited

U.S. PATENT DOCUMENTS

| | | | | |
|---|---|---|---|---|
| 4,108,023 | A * | 8/1978 | Garrison | E21B 4/006 175/106 |
| 4,683,964 | A | 8/1987 | Wenzel | |
| 5,738,178 | A * | 4/1998 | Williams | E21B 4/02 175/61 |
| 5,947,214 | A * | 9/1999 | Tibbitts | E21B 17/04 175/276 |
| 6,244,361 | B1 | 6/2001 | Comeau et al. | |
| 7,497,279 | B2 | 3/2009 | Hall et al. | |
| 7,562,725 | B1 | 7/2009 | Broussard et al. | |
| 9,115,793 | B2 * | 8/2015 | Nelson | F16H 15/503 |
| 2002/0066598 | A1 | 6/2002 | Rozendaal et al. | |
| 2002/0175003 | A1 | 11/2002 | Pisoni et al. | |
| 2004/0238219 | A1 * | 12/2004 | Nichols | E21B 17/00 175/57 |
| 2004/0262043 | A1 * | 12/2004 | Schuaf | E21B 3/02 175/57 |
| 2005/0034895 | A1 * | 2/2005 | Sawyer | E21B 7/067 175/45 |
| 2009/0152010 | A1 | 6/2009 | Salins et al. | |
| 2011/0284292 | A1 | 11/2011 | Gibb et al. | |
| 2016/0138381 | A1 * | 5/2016 | Logan | E21B 4/006 175/24 |

FOREIGN PATENT DOCUMENTS

| | | | |
|---|---|---|---|
| RU | 2478781 | C2 | 10/2013 |
| WO | WO-2013009312 | A1 | 1/2013 |
| WO | WO-2015099655 | A1 | 7/2015 |

OTHER PUBLICATIONS

"International Application Serial No. PCT/US2013/077460, International Search Report dated Sep. 25, 2014", 5 pgs.
"International Application Serial No. PCT/US2013/077460, Written Opinion dated Sep. 25, 2014", 9 pgs.

* cited by examiner

SECTION B-B

SECTION C-C

SECTION D-D

INDEPENDENT MODIFICATION OF DRILL STRING PORTION ROTATIONAL SPEED

PRIORITY APPLICATION

This application is a U.S. National Stage Filing under 35 U.S.C. 371 from International Application No. PCT/US2013/077460, filed Dec. 23, 2013; and published as WO 2015/099655 on Jul. 2, 2015; which application and publication are incorporated herein by reference in their entirety.

TECHNICAL FIELD

The present application relates generally to drilling systems for drilling into the Earth's crust. The application further relates to devices for incorporation in a drill string, to drill strings, to drilling installations, and to methods for drilling.

BACKGROUND

Boreholes or wellbores for hydrocarbon (oil and gas) production, as well as for other purposes, are usually drilled with a drill string that includes a plurality of interconnected tubular members (individually referred to as segments of drill pipe), having a drilling assembly which includes a drill bit attached to the bottom end thereof. The drill bit is rotated to shear or disintegrate material of the rock formation to drill the wellbore. The drill string often includes tools or other devices that are in operation located downhole and are therefore remotely activated and deactivated during drilling operations. Such tools and devices include, for example, reamers, stabilizers, steering tools for steering the drill bit, and formation testing devices.

The drill string is often drivingly rotated by the application of torque and rotation at the surface, so that a tubular wall of the drill string (also referred to herein as the drill pipe) is rotated at a common speed. While relatively high rotational speeds are often useful in some parts of the drill string (e.g., adjacent the drill bit, to agitate cuttings to promote efficient evacuation thereof), structural features in other parts of the drill string can often limit the speed at which the drill string can be operated safely.

BRIEF DESCRIPTION OF THE DRAWINGS

Some embodiments are illustrated by way of example and not limitation in the figures of the accompanying drawings, in which.

DETAILED DESCRIPTION

Figure 1:
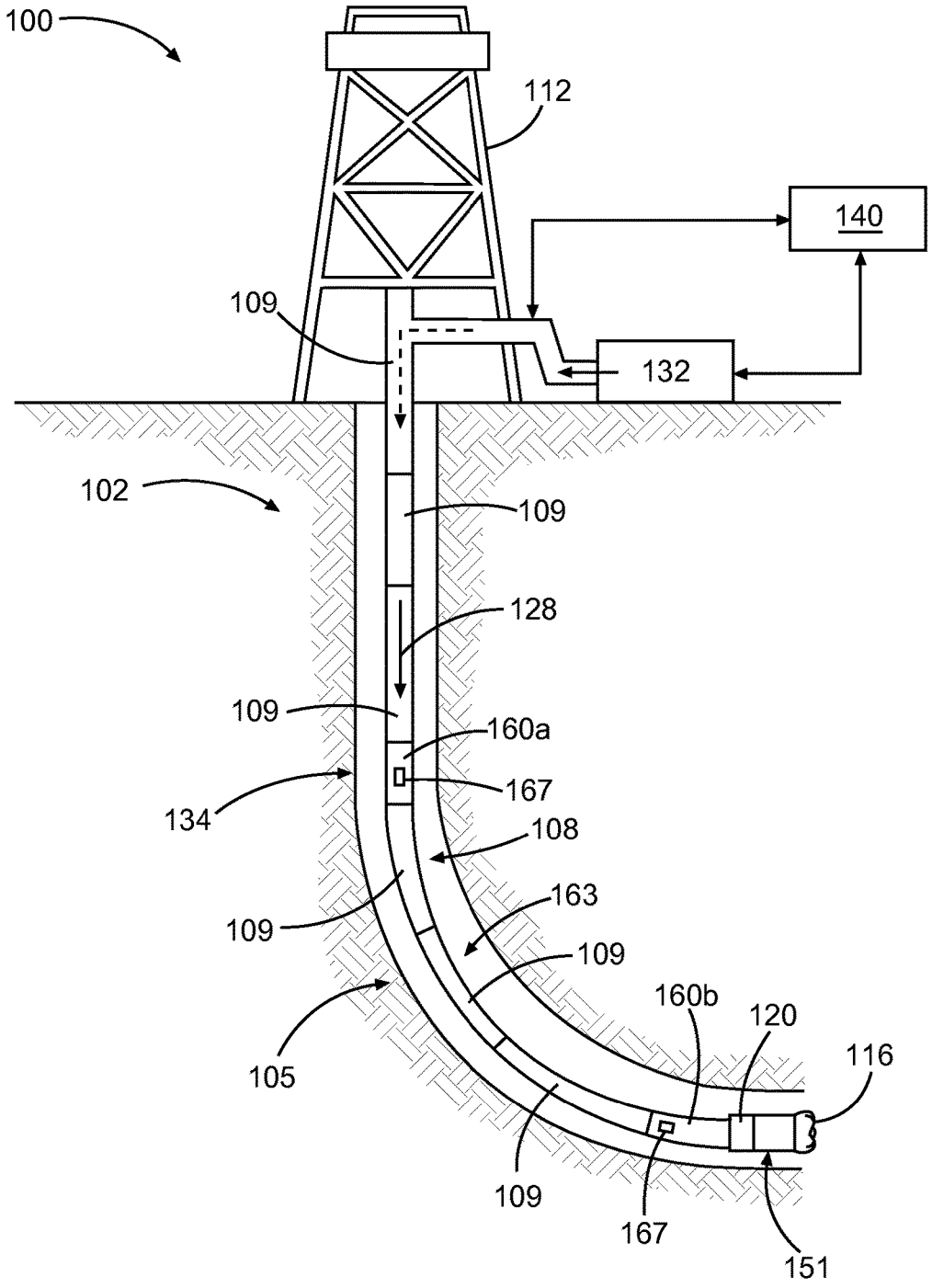
FIG. 1 depicts a schematic elevational diagram of a drilling installation in accordance with an example embodiment, the drilling installation including a drill string having a pair of transmission modifier devices in accordance with an example embodiment, the transmission modifier devices having opposite orientations to provide for selective rotation at a reduced speed of an intermediate portion of the drill string.

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

One aspect of the disclosure relates to a method comprising independently modifying a rotary speed of a downhole portion of a drill string relative to other downhole portions of the drill string, each of the portions comprising a plurality of drill pipe sections. Independent rotary speed modification means that speed modification is applied to the drill string in its entirety (for example by changing a speed at which the drill string is rotated at the surface), but that the speed of the downhole portion is modified without universal speed modification for the drill string.

In some embodiments, the modified-speed portion of the drill string comprises a downhole end portion of the drill string extending between a downhole end of the drill string and a transition point which is spaced from both ends of the drill string. The downhole end portion may be rotated at an increased speed relative to an uphole portion of the drill string above the transition point. In one embodiment, the transition point is located at or adjacent a downhole end of a curved portion of the borehole, so that the uphole portion of the drill string is curved for at least part of its length, while the downhole end portion may be substantially rectilinear. In such cases, the relatively higher rotary speed of the downhole end portion may facilitate drilling efficacy and may promote agitation of drilling mud in the borehole for evacuation of cuttings. Relatively slower rotation of the uphole portion of the drill string reduces wear on the drill string due to reduced exposure to loaded rotation while curved.

In other instances, the reduced-speed portion may be an intermediate portion of the drill string, in which case independent rotary speed modification of the intermediate portion results in rotation of the intermediate portion at a different speed from adjacent portions of the drill string located at opposite ends of the intermediate portion, in which case the adjacent portions may be rotated at a common rotary speed. In one embodiment, the intermediate portion may be a curved portion of the drill string, in which case the intermediate portion may be rotated at a reduced speed relative to portions of the drill string uphole and downhole of the curved portion. In other embodiments, an intermediate portion may be rotated at an increased speed relative to rotary speeds of drill string portions at opposite ends of the intermediate portion.

Another aspect of the disclosure relates to a modifier device that is configured for incorporation in a drill string to transfer torque and rotation of a tubular drill string wall between neighboring drill string sections, the transmission modifier device being switchable between a disengaged mode in which it is configured to transfer the drill string torque and rotation without modification, and an engaged mode in which the transmission modifier device is configured to deliver drill string torque and rotation at a modified output speed relative to an input speed received by the transmission modifier device.

The transmission modifier device may have a transmission mechanism that drivingly couples an input member and an output member, and provides for selective speed modification. The transmission mechanism may comprise a planetary gear system. In such cases, the device may be configured to switch to the engaged mode by rotationally anchoring a ring gear member of the planetary gear system to a borehole wall, and synchronously allowing rotation of a sun gear member and a planet gear carrier member relative to the ring gear member. An anchor mechanism for rotationally anchoring the ring gear member to the borehole wall may be configured to permit axial movement uphole and downhole by the device while it is in the engaged mode. The device may thus be configured for axial translation along the borehole, while the ring gear member is rotationally anchored to the borehole wall. The device may further be configured to switch to the disengaged mode by releasing rotational anchoring of the ring gear member to the borehole wall, and by rotationally keying at least one of the planet gear carrier member and the sun gear member to the ring gear member. The device may further comprise a switching member that is configured for actuated displacement into an engagement position in which it causes both (a) rotational anchoring of the ring gear member to the borehole wall, and (b) rotational release of at least one of the sun gear member and the planet gear carrier member from the ring gear member.

Another aspect of the disclosure comprises a drill string having a plurality of the transmission modifier devices incorporated therein. In one embodiment, at least two of the transmission modifier devices are spaced along the drill string to define between them an intermediate portion which is at least multiple drill string section lengths in longitudinal extent.

A further aspect of the disclosure comprises a method of drilling which comprises incorporating two or more of the transmission modifier devices in a drill string, and switching at least one of the transmission modifier devices between the engaged mode and the disengaged mode while the transmission modifier device is located downhole in a borehole along which the drill string extends.

The method may further comprise disposing the two or more transmission modifier devices in respective engagement modes such that a curved portion of the drill string rotates at a lower speed than a substantially rectilinear portion of the drill string. In one embodiment, the method comprises: incorporating a series of longitudinally spaced transmission modifier devices in the drill string, each transmission modifier device being configured to increase drill string speed across it, and switching a particular one of the transmission modifier devices from the disengaged mode to the engaged mode when the particular transmission modifier device is located downhole a speed limitation portion of the borehole, so that components of the drill string uphole of the particular transmission modifier device (including portions of the drill string located in the speed limitation portion) rotates more slowly than components of the drill string downhole of the particular transmission modifier device. In one example embodiment, the speed limitation portion of the borehole comprises a curved, angled, or bent portion of the borehole, in which case selective engagement and disengagement of the series of transmission modifier devices can be used to consistently rotate portions of the drill string in the curved portion and a relatively low speed, while rotating portions of the drill string downhole of the curved portion (e.g., including a substantially rectilinear portion of the borehole) at a relatively high speed.

The transmission modifier devices may be similar or identical modular units that are configured for incorporation at any position of the drill string, having connection formations that are compatible with drill pipe sections making up the drill string, so that a plurality of the transmission modifier devices forms a modular kit for dynamically customizing rotational behavior of the drill string at different portions along its length.

One example embodiment of a transmission modifier device, a drill string incorporating in the example transmission modifier device, and an example embodiment of a method of drilling with use of the transmission modifier device, will now be described with reference to FIG. 1, in which reference number 100 generally indicates a drilling installation that includes a drilling system 102 in accordance with an example embodiment. The drilling installation 100 includes a subterranean borehole 104 in which a drill string 108 is located. The drill string 108 may comprise jointed drill string sections suspended from a drilling platform 112 secured at a wellhead and connected together for transmission of torque and rotation from the platform 112 to the drill bit 116. A majority of the drill string 108 may be composed of drill pipe sections 109, each of which comprises, in this example, a length of drill pipe that is of monolithic construction and has a standardized length (further referred to herein as a drill string section length). A downhole assembly or bottom hole assembly (BHA) 151 at a bottom end of the drill string 108 may include a drill bit 116 to disintegrate earth formations, piloting the borehole 104, and may include one or more reamer assemblies, uphole of the drill bit 116 to widen the borehole 104 by operation of selectively deployable cutting elements. A measurement and control assembly 120 may be included in the BHA 151, which also includes measurement instruments to measure borehole parameters, drilling performance, and the like.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. In the example of FIG. 1, the borehole 104 includes a curved portion 105. As used with reference to the borehole 104 and components herein, the "axis" of the borehole 104 (and therefore a main axis of the drill string 108 or part thereof) means the longitudinally extending centerline of the cylindrical borehole 104 (corresponding, for example, to longitudinal axis 248 in FIG. 2).

"Axial" and "longitudinal" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" or "rotational" means a substantially arcuate or circular path described by rotation of a tangential vector about the borehole axis. "Rotation" and its derivatives mean not only continuous or repeated rotation through 360° or more, but also includes angular or circumferential displacement of less than 360°.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and towards the earth's surface. Note that in FIGS. 2 and 5 of the drawings, the downhole direction of the drill string 108 extends from left to right.

Drilling fluid (e.g. drilling "mud," or other fluids that may be in the well), is circulated from a drilling fluid reservoir, for example a storage pit, at the earth's surface (and coupled to the wellhead) by a pump system 132 that forces the drilling fluid down internal bore 128 provided by a hollow interior of the drill string 108, so that that the drilling fluid exits under relatively high pressure through the drill bit 116. After exiting from the drill string 108, the drilling fluid moves back upwards along the borehole 104, occupying a borehole annulus 134 defined between the drill string 108 and a wall of the borehole 104. Although many other annular spaces may be associated with the system 102, references to annular pressure, annular clearance, and the like, refer to features of the borehole annulus 134, unless otherwise specified or unless the context clearly indicates otherwise.

Note that the drilling fluid is pumped along the inner diameter (i.e., the bore 128) of the drill string 108, with fluid flow out of the bore 128 being restricted at the drill bit 116. The drilling fluid then flows upwards along the annulus 134, carrying cuttings from the bottom of the borehole 104 to the wellhead, where the cuttings are removed and the drilling fluid may be returned to a drilling fluid reservoir forming part of the pump system 132. Fluid pressure in the bore 128 is therefore greater than fluid pressure in the annulus 134. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. Transmission of such drill string torque and rotation is by means of a composite tubular wall, also referred to herein as a drill pipe wall 217 (see FIGS. 2A and 2B) provided by respective tubular walls of the drill pipe sections 109 making up the drill string 108. This drill string rotation (in which the composite drill pipe formed by the drill string 108 is rotated) is to be distinguished from driven rotation of drill string components relative to the drill pipe wall 217, e.g., driven rotation of the drill bit 116 or a drill bit drivetrain by a downhole motor that may form part of the drill string 108. In this example embodiment, a downhole motor (such as, for example, a so-called mud motor or turbine motor) disposed in the drill string 108 and, this instance, forming part of the BHA 151, may contribute to rotation of the drill bit 116. In this example, those parts of the drill string 108 located uphole of the mud motor in the BHA 151 powered by surface equipment that apply torque and rotation to a topmost drill pipe section 109 at the drilling platform 112.

The system 102 may include a surface control system 140 to receive signals from downhole sensors and telemetry equipment, the sensors and telemetry equipment being incorporated in the drill string 108, e.g. forming part of the measurement and control assembly 120. The surface control system 140 may display drilling parameters and other information on a display or monitor that is used by an operator to control the drilling operations. Some drilling installations may be partly or fully automated, so that drilling control operations may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of downhole tools and/or surface devices.

Measurement and control communications between the surface control system 140 and downhole components (e.g., the measurement and control assembly 120, and/or control devices in respective downhole tools incorporated in the drill string 108) may be achieved by various known drill string data transmission modes, or combinations thereof. Remote control of downhole tool deployment, engagement, or mode switching can thus be effected, inter alia, by control signals comprising acoustic signals, or electromagnetic, or fluid pulse signals transmitted by drilling fluid in the internal bore 128, by acoustic signals transmitted via longitudinal or rotational waves in the composite drill pipe wall 217, electrical signals transmitted along a conductor incorporated in the drill string and extending along it, and/or by electromagnetic signals transmitted at least in part via geological formations in which the borehole 104 is located. Note that the above-mentioned example data transmission modes are non-exhaustive, and that any suitable data transmission mechanism may be used to control operation of drill string components, e.g. to switch transmission modifier devices as disclosed herein between different engagement modes.

The system 102 further includes transmission modifier devices in the example form of gearboxes 160 that are incorporated in the drill string and are configured for selective activation to modify the speed of drill string rotation transmitted across them, while inversely modifying drill string torque transmitted across them. In the embodiment of FIG. 1, the gearboxes 160 include a pair of transmission modifier devices in the example form of an upper gearbox 160*a* and a lower gearbox 160*b*. Each gearbox 160 is connected in-line in the drill string 108 to transfer drill string torque and rotation from a respectively immediately adjacent uphole drill pipe section 109 to an immediately adjacent downhole drill pipe section 109. Note that the gearboxes 160 need not necessarily be connected to the drill pipe sections 109, but that a particular gearbox 160 may, in other example embodiments, be drivingly connected to any other drill string section configured for receiving or delivering drill string torque and rotation.

The upper gearbox 160*a* and the lower gearbox 160*b* are spaced apart along the length of the drill string 108 defining between them an intermediate portion 163 consisting, at least in part, of multiple drill string sections. In this example, the intermediate portion 163 comprises multiple drill pipe sections 109, and may thus be multiple drill pipe section lengths in longitudinal extent. Note that, in this example, each gearbox 160 has a length shorter than the standard drill pipe length. In other embodiments, transmission modifier devices similar or analogous to the gearboxes 160 can be dimensioned to have a length equal to the relevant standard drill pipe section length. Note also that the term "drill string section" herein means a separable unit (whether of composite or monolithic construction) that makes up part of the length of the drill string 108, and that transfers drill string torque and rotation from one end thereof to the other. Each gearbox 160 thus itself constitutes a drill string section in accordance with the terminology of this disclosure. As mentioned previously, drill string sections making up the intermediate portion 163 may thus include not only monolithic drill pipe sections 109, but may also include, for example, one or more drill string tools, telemetry controls subs, and/or further gearboxes 160.

Figure 2A:
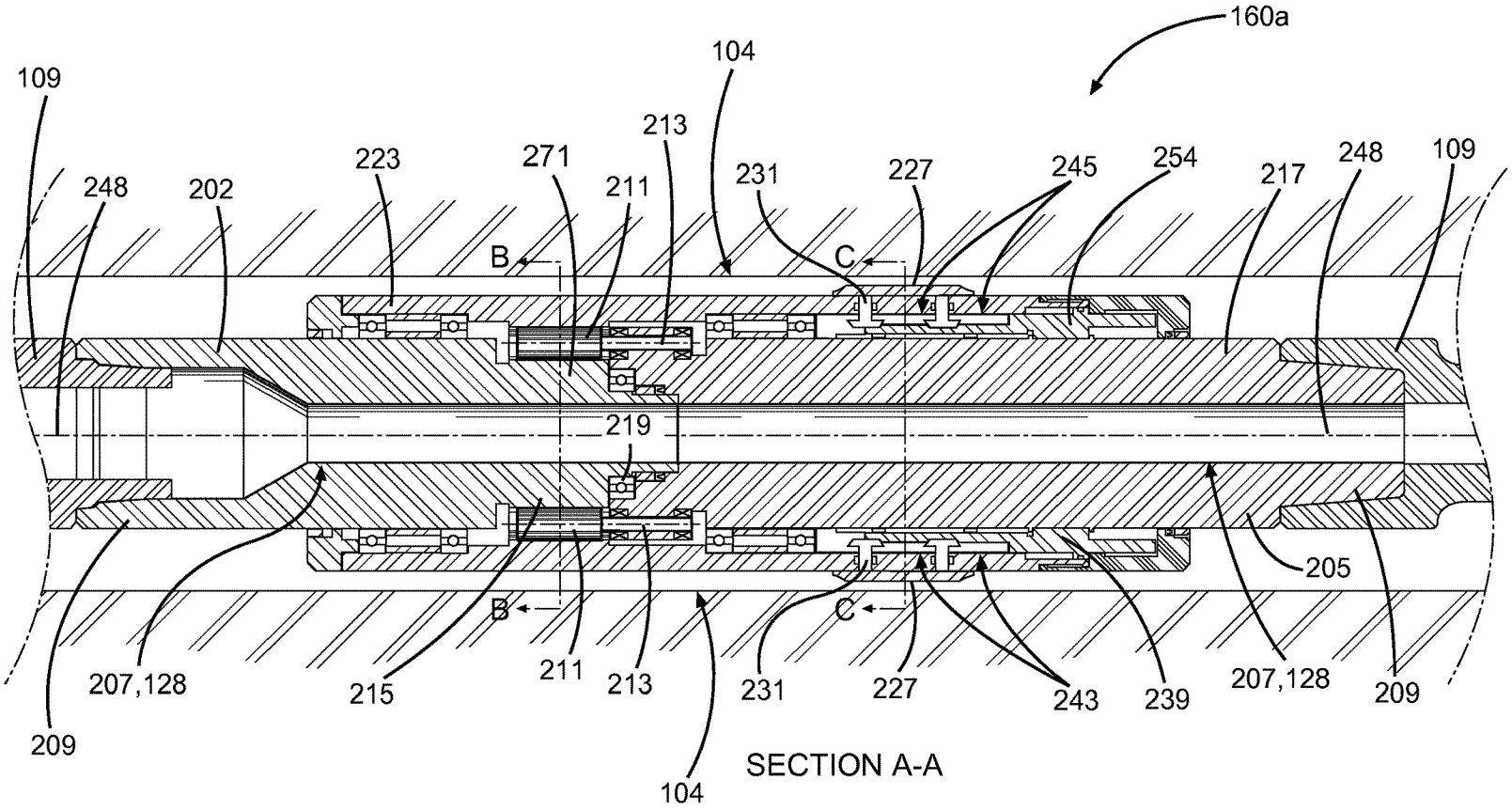
FIGS. 2A-2B depict respective axial sections of a transmission modifier device in accordance with an example embodiment taken along line A-A in FIG. 3, the transmission modifier device being disposed in a disengaged mode in FIG. 2A and being disposed in an engaged condition in FIG. 2B.
Figure 2B:
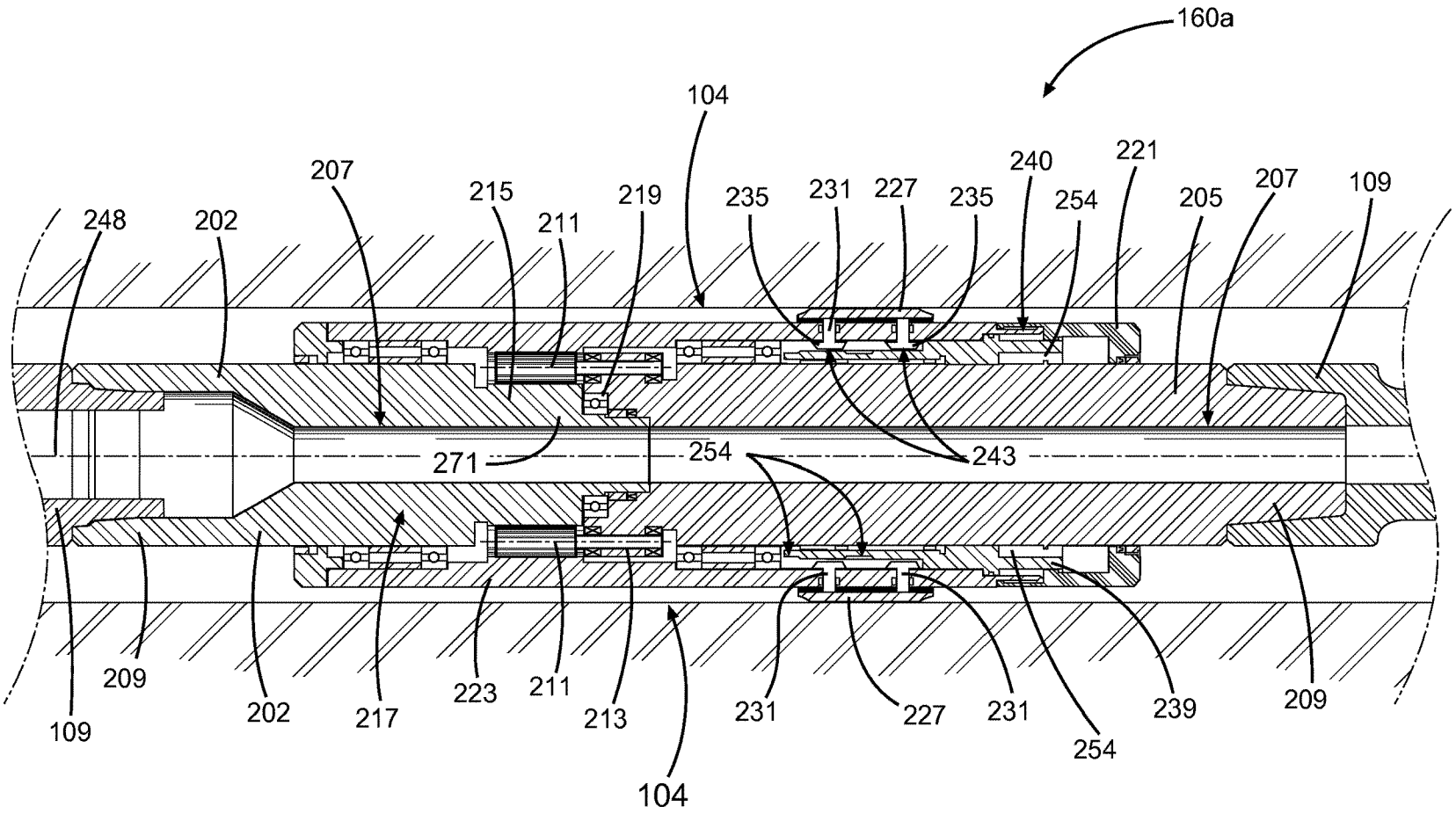

Configuration and operation of the gearboxes 160 to provide selective speed modification functionality will now be described with reference to FIGS. 2-5. Each gearbox 160 is selectively switchable between an engaged mode in which it modifies the speed of the drill string rotation across it, and a disengaged mode in which it transmits unmodified torque and rotation from one end thereof to the other. FIG. 2A shows an example gearbox 160*a* in the disengaged mode, and FIG. 2B shows the example gearbox 160*a* in the engaged mode.

The gearbox 160*a* has a rotary input member and a rotary output member in the example form of a pair of co-axially aligned hollow driveshafts arranged end-to-end. In this example embodiment, the driveshafts comprise a sun gear shaft 202 and a planet gear carrier shaft 205 (so named for reasons that will be evident from what follows). Each of the driveshafts 202, 205 is generally tubular, defining a fluid passage 207 that extends co-axially therethrough. When the gearbox 160*a* is incorporated in the drill string 108, each fluid passage 207 of the respective driveshafts 202, 205 defines a portion of the internal bore 128 of the drill string 108 along its length. The fluid passages 207 are of identical inner diameter and are in end-to-end fluid flow communication. The fluid passages 207 thus together form a composite fluid conduit extending continuously through the gearbox 160*a*, being substantially unoccluded and having a consistent cross-sectional profile along its length. Note that, in other embodiments, an analogous gearbox may define a continuously extending composite fluid conduit of which the cross-sectional profile varies along the length of the fluid conduit.

Each one of the driveshafts 202, 205 has a connection formation 209 at its outer end (i.e., at the end thereof furthest from the other driveshaft 205, 202). Each connection formation 209, in use, connects the driveshafts 202, 205 to an adjacent drill pipe section 109 (or, in other embodiments, to an adjacent drill string section), to form a joint across which drill string torque and rotation can be transmitted. Note that in FIGS. 2A and 2B show the gearbox 160*a* in isolation, and therefore permit the uphole- and downhole adjacent drill pipe sections 109 to which the sun gear shaft 202 and the planet gear carrier shaft 205 are respectively connected.

The connection formations 209 in this embodiment provide for screw threaded box joints in which one connection formation 209 is screw-threadedly received spigot/socket-fashion in a complementary connection formation 209. The connection formations 209 of the gearbox 160*a* comprise a pair of complementary connection formations 209 (e.g., male- and female formations), to facilitate compatible and interchangeable in-line incorporation of the gearbox 160*a* in the drill string 108. Complementarity of the connection formations 209 also facilitates end-to-end connection of two or more of the gearboxes 160, if speed modification is at a greater ratio than provided by a single gearbox 160 is to be applied. Note that the direction of rotation of the driveshafts 202, 205 is maintained to be clockwise, when looking downhole. This consistent direction of rotation is maintained throughout, whether the gearbox 160 is arranged for step up modification, is arranged for step down modification, is in the engaged mode, or is in the disengaged mode.

As will be evident from the description that follows, one of the driveshafts 202, 205 serves in operation as an input member, or input shaft; with the other driveshaft 202, 205 serving as an output member, or output shaft. Whether a particular gearbox 160 functions as a step-up modifier (to increase rotational speed) or a step-down modifier (to decrease rotational speed) depends on which one of the sun gear shaft 202 and the planet gear carrier shaft 205 functions as the input shaft. Because drill string torque and rotation is typically transmitted in the downhole direction, originating at the drilling platform 112, the driveshaft 202, 205 that is located at the uphole end of the particular gearbox 160 will typically function as the input shaft. In the example embodiment of FIG. 1, the pair of gearboxes 160 are substantially similar, but have opposite orientations. The upper gearbox 160*a* is oriented to provide step-down functionality (speed-wise), while the lower gearbox 160*b* is oriented to provide step-up modification of drill string rotation speed. FIG. 2 shows the upper gearbox 160*a* in its operational, step-down, orientation, with the sun gear shaft 202 being located at the uphole end. In some embodiments, the gearboxes 160 may be reversible, so that a particular gearbox 160 can be used as a step-up or as a step-down modifier, depending on on-site selection of the orientation in which it is connected in the drill string 108.

In this embodiment, however, each gearbox 160 is configured for either step-down or step-up operation depending on the nature of the connection formations 209. The upper gearbox 160*a*, for example, is configured for step-down configuration by having a female connection formation 209 on its sun gear shaft 202, and a complementary male connection formation 209 on its planet gear carrier shaft 205. The example lower gearbox 160*b* (not illustrated separately) is identical in construction to the example upper gearbox 160*a*, except that its planet gear carrier shaft 205 has a female connection formation 209 (thus being configured for incorporation in the drill string 108 such that its planet gear carrier shaft 205 is at the uphole end of the device), while its sun gear shaft 202 has a male connection formation 209.

Each gearbox 160 includes a transmission mechanism to transfer torque and rotation from the input shaft to the output shaft. The transmission mechanism comprises a planetary gear system that includes a set of planet gears 211 carried by the planet gear carrier shaft 205. The planet gear carrier shaft 205 thus serves as a planet gear carrier for the planetary gear system. The planet gears 211 are mounted on the planet gear carrier shaft 205 at an uphole end thereof, being regularly circumferentially spaced about the main longitudinal axis 248 of the gearbox 160 at a constant radius (see FIG. 3). Each planet gear 211 is rotatable relative to the planet gear carrier shaft 205 about a respective planet axis 213 that extends longitudinally, being parallel to the main longitudinal axis 248. A circular ring described by the planet axes 213 of the set of planet gears 211 is co-axial with the longitudinal axis 248 of the gearbox 160*a*, and is thus also co-axial with the co-axially aligned driveshafts 202, 205. The planet axes 213 have a fixed spatial relationship to the planet gear carrier shaft 205, and are thus rotatable within the planet gear carrier shaft 205 about the main longitudinal axis 248.

Figure 3:
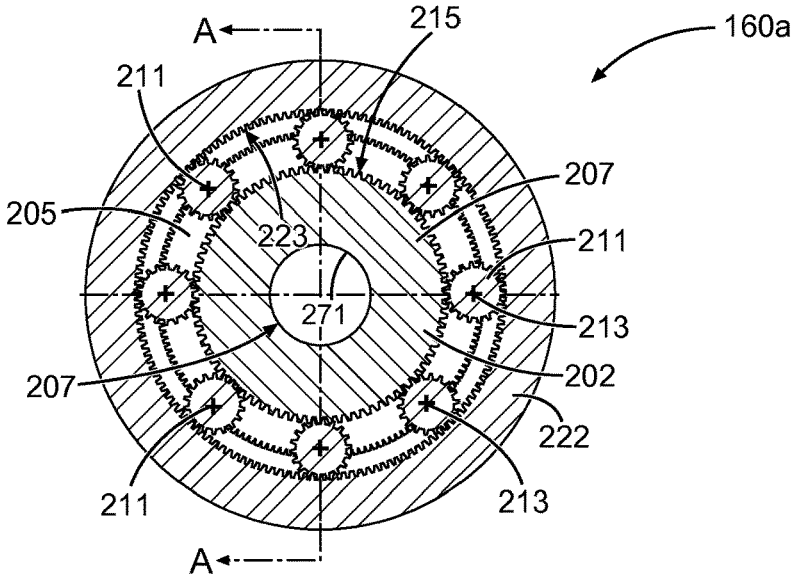
FIG. 3 depicts a schematic cross-sectional view of the example transmission modifier device, taken along line B-B in FIG. 2A.

A downhole end of the sun gear shaft 202 is shaped to provide an external sun gear 215 (see, in particular, FIG. 3). The sun gear 215 comprises a circumferentially extending set of gear teeth on a radially outer surface of a reduced diameter spigot structure 271 defined by the downhole end of the sun gear shaft 202. A central boss projects axially from the spigot structure 271 and is journaled in a roller bearing 219 housed co-axially in a complementary socket in the uphole end of the planet gear carrier shaft 205. The planet gears 211 are in mesh with the sun gear 215.

The gearbox 160*a* further comprises a tubular housing 221 in which a majority of the lengths of the driveshafts 202, 205 (and, in particular, their adjoining ends) are co-axially housed. The housing 221, in this example embodiment, serves multiple purposes, one of which is to provide a ring gear 223 of the planetary gear system of the transmission mechanism that drivingly connects the input shaft (202) to the output shaft (205). In this example embodiment, the housing 221 thus constitutes a ring gear body on which the ring gear 223 is provided. The ring gear 223 is an internal gear formed on the housing 221, thus comprising a circumferentially extending set of gear teeth on a cylindrical inner surface of the tubular housing 221, being in axial register with the planet gears 211. The planet gears 211 are in synchronous mesh with the sun gear 215 and the ring gear 223. Being part of a planetary gear set, the gear teeth of the planet gears 211, the sun gear 215, and the ring gear 223 are configured for meshing, having a common circular pitch, and having similar working depths.

The gearbox 160*a* further has a switching mechanism to switch the planetary gear transmission mechanism between the engaged mode (FIG. 2B) and the disengaged mode (FIG. 2A). In the engaged mode, the sun gear shaft 202 and the planet gear carrier shaft 205 rotate at the same speed, so that the gearbox 160*a* transmits torque and rotation from one end thereof to the other at an unmodified speed. In the disengaged mode, the planet gear carrier shaft 205 rotates slower than the sun gear shaft 202, so that the gearbox 160*a* modifies the speed of drill string rotation during the transmission thereof.

In this embodiment, the gearbox 160*a* is in the disengaged mode when the housing 221 is (a) free to rotate relative to the geological formation through which the borehole 104 extends, while (b) the housing 221 is rotationally keyed to the planet gear carrier shaft 205. It will be appreciated that keyed rotation of two of the three main components of a meshed planetary gear set (here, the planet gear carrier shaft 205 and the ring gear member provided by the housing 221) necessarily causes rotation of the remaining main component (here, the sun gear shaft 202) at the same, common speed. In other embodiments, rotational keying off planetary gear system components for operation in the disengaged mode may comprise locking together of a different pair of main planetary gear set components. In the engaged mode (FIG. 2B), however, the main planetary gear system components are rotatable relative to one another, but the housing 221 is rotationally anchored relative to the formation through which the borehole 104 extends.

Figure 4:
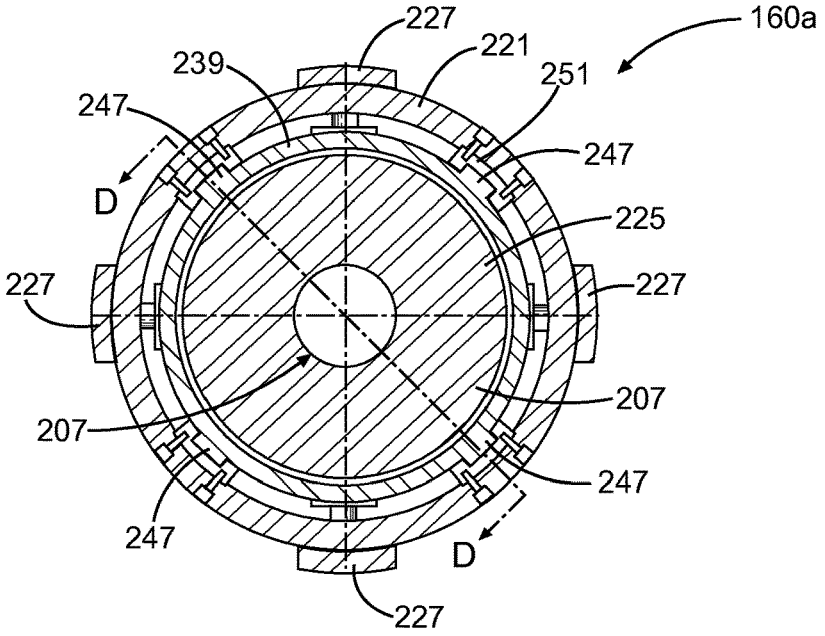
FIG. 4 depicts another schematic cross-sectional view of the example transmission modifier device, taken along line C-C in FIG. 2A.

The switching mechanism includes an anchor mechanism configured to allow selective anchoring of the housing 221 against rotation relative to the formation. In this example embodiment, the anchor mechanism comprises set of anchor members in the example form of anchor shoes 227 mounted on the housing 221 for radial displacement relative to the housing 221, to selectively engage a borehole wall 118 (see FIG. 1) for rotationally anchoring the housing 221, and, by extension, the ring gear 223. Turning briefly to FIG. 4, it can be seen that the example gearbox 160*a* has four anchor shoes 227 circumferentially spaced at regular intervals on the housing 221. Each anchor shoe 227 is radially displaceable between (a) a retracted condition (FIGS. 2A and 3) in which the anchor shoe 227 is radially retracted, lying flat against the radially outer surface of the housing 221, to achieve a radial clearance between the borehole wall 118 and a radially outer contact surface of the anchor shoe 227; and (b) a deployed condition (FIG. 2B) in which the anchor shoes 227 project radially further from the housing 221 than is the case in the retracted condition, so the radially outer contact surfaces of the anchor shoe 227, in operation, bear against the borehole wall 118, resisting rotation of the anchor shoe 227 (and therefore of the housing 221 to which it is keyed) due to tangential resistive forces acting between the borehole wall 118 and the anchor shoe 227.

The anchor shoe 227 may be configured for permitting longitudinal movement along the borehole 104, while resisting rotation. In such cases, each anchor shoe 227 may have, for example, a shaped radially outer surface that defines a number of longitudinally extending blades or ridges to cut into the borehole wall 118 and to permit longitudinal sliding of the housing 221 along the borehole 104, while resisting or preventing rotation of the housing 221 relative to the borehole wall 118. In other embodiments, anchor members analogous to the anchor shoe 227 may include rollers mounted on the housing 221 for rotation about tangentially extending roller axes. In such cases, the rollers can be disc-shaped and may taper to a radially outer blade edge, so that each roller cuts plowshare-fashion into the borehole wall 118, in operation. This can provide a positive tangential anchoring interface between the roller and the borehole wall 118, while allowing substantially frictionless rolling 221 along the borehole 104.

An actuating mechanism to actuate and guide radial movement of the anchor shoes 227 (and to force the contact surfaces of the anchor shoes 227 against the borehole wall 118 for facilitating sufficiently large tangential frictional braking forces) includes a pair of longitudinally spaced pushrods 231. Each pushrod 231 extends radially through a tubular wall of the housing 221, having a flattened mushroom-shaped head 235 held captive in the interior of the housing 221 at an inner end of the pushrod 231 for cam-following engagement with a cam structure forming part of a switch piston 239 (more on this below) to push the anchor shoe 227 radially outwards, poppet valve-fashion, via the pushrods 231. Each anchor shoe 227 can have a bias mechanism that biases the anchor shoe 227 to the retracted condition. Such a bias mechanism can include, e.g., respective helical compression springs acting between the head 235 of each pushrod 231 and the housing 221.

The switching mechanism can further comprise a switch member displaceable relative to the housing 221. In this example embodiment, the switch member is provided by the switch piston 239, which is located radially between the planet gear carrier shaft 205 and the housing 221, and is axially slidable relative to both the housing 221 and the planet gear carrier shaft 205 between a disengagement position (FIG. 2A) in which the gearbox 160*a* is switched to the disengaged mode, and an engagement position (FIG. 2B) in which the gearbox 160*a* is switched to the engaged mode. The switch piston 239 is generally tubular and is sealingly engaged with both the housing 221 and with the planet gear carrier shaft 205 to define a pair of hydraulic pressure chambers 240 separated by an annular rib forming part of the switch piston 239. Hydraulic actuation of the switch piston 239, to cause axial movement thereof uphole or downhole can be achieved by delivering pressurized hydraulic control fluid to a corresponding one of the pressure chambers 240.

A radially outer surface of the switch piston 239 has a shaped topography defining a cam surface to translate axial movement of the switch piston 239 to radial movement of the pushrods 231, and by extension of the anchor shoe 227. The cam surface in this embodiment comprises an axially spaced pair of recesses 245 that are complementary in shape and spatial arrangement to the heads 235 of the pushrods 231. When the switch piston 239 is in the disengaged position, when the pushrod heads 235 are in register with the recesses 245 (FIG. 2A), radial retraction of the pushrods 231 is permitted, allowing displacement of the anchor shoe 227 radially inwards into the retracted condition. When, however, the pushrod heads 235 are axially out of register with the recesses 245 (FIG. 2B), the pushrod heads 235 abut against radially raised surfaces 243, preventing radially inward movement of the pushrods 231 and thereby keeping the anchor shoe 227 in the deployed condition. Transition areas between the recesses 245 and the raised surfaces 243 are chamfered or inclined, to engage complementary bevels on peripheral edges on the respective pushrod heads 235 during axial movement of the switch piston 239.

Each gearbox 160 further comprises a control arrangement 167 (schematically shown in FIG. 1) to control switching of the transmission mechanism between the engaged and disengaged modes, in this example by controlling axial positioning of the switch piston 239. The control arrangement 167 include a signal receiver configured to receive and decode control signals originating, e.g., at the surface control system 140, and/or from the measurement and control assembly 120 forming part of the BHA 151. As mentioned, the control signals can be fluid pulse signals, electrical signals, electromagnetic signals, acoustic signals, or any other suitable data carrier signal.

The control arrangement 167 may be operatively connected to an actuating mechanism to cause actuated axial displacement of the switch piston 239 between the engagement position and the disengagement position. In this example embodiment, the actuating mechanisms comprises a hydraulic actuating arrangement that controls axial positioning of the switch piston 239 by controlling a pressure differential in the housing 221 across the switch piston 239 (e.g., by selectively pressurizing one of the pair of pressure chambers 240, as will be evident from a comparison of FIG. 2A and FIG. 2B). The hydraulic fluid used for actuating the switch piston 239 can, in some embodiments, be a hydraulic control fluid, such as oil, pressurized by a dedicated liquid pump incorporated in the gearbox 160. In other embodiments, axial displacement of the switch piston 239 may be hydraulically actuated with drilling fluid conveyed downhole through the internal bore 128 and back uphole via the annulus 134. The actuating mechanism can, in some embodiments, use a pressure difference between the bore pressure and the annulus pressure to actuate the switch piston 239. Such pressure difference control may be provided by one or more valves forming part of the switching mechanism and configured for selectively isolating or placing the respective pressure chambers 240 of the gearbox 160*a* in fluid flow communication with the annulus 134 or with the internal bore 128. The control arrangement 167 can, in such cases, be configured to control the valve arrangement responsive to control signals received by the control arrangement 167, thus enabling remote control over disposal of each gearbox 160 individually in either of the engaged mode, or the disengaged mode. A person skilled in the art will appreciate that tool control and component actuation can be effected in a number of alternative ways, which may include electromechanical control and activation; electrohydraulic control and activation; and purely mechanical or exclusively hydro-mechanical control and activation.

The switching mechanism may further include a locking mechanism to rotationally lock at least one of the driveshafts 202, 205 to the housing 221 when the gearbox 160*a* is in the disengaged mode, but to unlock the driveshafts 202, 205 from the housing 221 when the gearbox 160 is in the engaged condition, allowing rotation of the respective driveshafts 202, 205 relative to the housing 221 at different speeds. In this example embodiment, the switch piston 239 forms part not only of the anchor mechanism (in which it serves as cam member causing radial extension of the anchor shoes 227), but also forms part of the locking mechanism. For this purpose, the switch piston 239 includes a set of keys 247 that are axially receivable in complementary keyways 251 fast with the housing 221. As can best be seen in FIG. 4 of the drawings, the example gearbox 160*a* has a set of four circumferentially spaced key/keyway pairs (247/251), each providing a parallel key joint between the switch piston 239 and the housing 221. A similar keying mechanism is provided for rotationally keying the switch piston 239 to the planet gear carrier shaft 205. In this example, the keying mechanism comprises a spline joint that includes complementary rib-spline formations 254 on the switch piston 239 and planet gear carrier shaft 205 respectively. As shown in FIG. 2A and in FIG. 5, the rib- and spline formations 254 are positioned such that they mesh when the switch piston 239 is in the disengagement position (thus rotationally keying the planet gear carrier shaft 205 to the housing 221, via the switch piston 239), and such that the spline formations 254 are axially clear of the complementary rib formations when the switch piston 239 is in the engagement position (see FIG. 2B), thus allowing rotation of the planet gear carrier shaft 205 relative to the housing 221.

Figure 5:
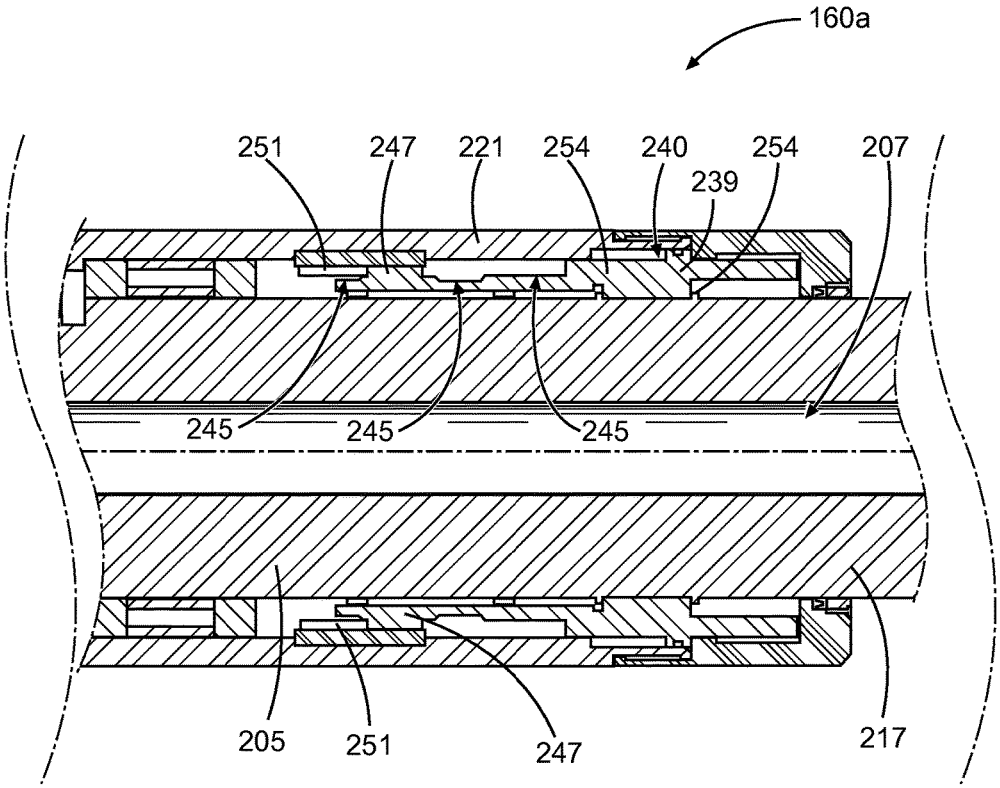
FIG. 5 depicts an axial section of the transmission modifier device in accordance with the example embodiment of FIGS. 1-4, taken along line D-D in FIG. 4.

In this example embodiment, the keyways 251 are dimensioned such that the respective keys 247 are not moved axially clear of the corresponding keyway 251 when the switch piston 239 is in the engagement position, so that the switch piston 239 is permanently keyed to the housing 221, while being slidable relative to it. In the engaged mode, the switch piston 239 thus rotates with the housing 221, free of the planet gear carrier shaft 205. As mentioned, rotational disengagement between the switch piston 239 and the planet gear carrier shaft 205 is caused by axial misalignment of their respective spline formations 254 when the switch piston 239 slides axially uphole into the engagement position (FIG. 5).

One or more transmission modifier devices, such as the example gearbox 160*a* described with reference to FIGS. 2-5, can be fitted within the BHA 151 or any other part of the drill string 108, to allow variable rotational speeds in different portions of the drill string 108, as operationally needed. When no transmission speed modification a particular gearbox 160 is needed, the gearbox 160 is disposed in the disengaged mode, so that it transfers rotational drill string speed above it to all components below it at an equivalent speed. Referring briefly again to FIGS. 2A and 3-5, it can be seen that and when thus disengaged, unmodified rotation and torque transmission is caused by rotation in unison of the input member (e.g., the sun gear shaft 202), the housing 221, the switch piston 239, and the output member (e.g., the planet gear carrier shaft 205). It will be appreciated that, during such interlocked rotation, the planet axes 213 of the planet gears 211 rotate about the longitudinal axis 248 at the same rotational speed as the sun gear shaft 202. This is because the switch piston 239 is rotationally keyed to the planet gear carrier shaft 205 by the rib- and spline formations 254, and is rotationally keyed to the housing 221 (and by extension to the ring gear 223) by the key joints provided by the engaged keys 247 and keyways 251.

The gearbox 160*a*, or multiple gearboxes 160, can be operated by communication from the surface control system 140, to selectively switch to the engaged mode (FIG. 2B). In the engaged mode, the anchor shoes 227 are pressed against the borehole wall 118, preventing rotation of the housing 221 relative to the formation. This rotational locking of the housing 221 provides a locked ring gear 223 for operation of the planetary gear set to modify rotational speed. At the same time, the spline formations 254 of the switch piston 239 are disengaged from the complementary rib formations of the planet gear carrier shaft 205, so that rotational interaction and torque transfer between the planet gear carrier shaft 205 and the housing 221 is substantially exclusively by engagement of the planet gears 211 with the ring gear 223 provided by the housing 221. The planet gears 211 rotate about their respective planet axes 213 in a direction opposite to the rotational direction of both the sun gear shaft 202 and the set of planet axes 213. Because each planet gear 211 is in mesh both with the ring gear 223 and with the sun gear 215, and because the ring gear 223 is stationary, a momentary tangential speed of the corresponding planet axis 213 equal to substantially half of the momentary tangential speed of the sun gear 215. Because the planet axes 213 and the teeth of the sun gear 215 lie at different radii from the rotational axis 248, however, the planet axes 213 (and by extension the planet gear carrier shaft 205) rotate at a fixed, reduced ratio relative to the sun gear shaft 202. In this example embodiment, the ratio of the rotational speed of the sun gear shaft 202 to the rotational speed of the planet gear carrier shaft 205 is 2.5:1. The torque modification ratio is the inverse of the speed modification ratio. For a differently oriented gearbox 160 (e.g., with the planet gear carrier shaft 205 located at the uphole end of the device), similar mechanics, but in reverse, results in a speed increase (and a proportional torque decrease) in the same ratio. Although the example transmission modifier devices provided by the gearboxes 160 can deliver on a fixed-ratio speed modification, other embodiments may include more complex gear systems in which a number of different speed modification ratio is mainly available for selection via remote controlled gearshift functionality.

Various operational uses of transmission modifier devices such as the example gearbox 160*a* is possible to achieve different rotational speeds for the tubular wall of the drill string 108 in different portions of the drill string 108. In the example embodiment of FIG. 1, the pair of gearboxes 160 can be engaged to reduce rotational speed in the intermediate portion 163 of the drill string 108 when it is at least partially in the curved portion 105 of the borehole 104, while enabling relatively high rotational speeds in parts of the drill string 108 outside of the curved portion 105.

High bends (also referred to as doglegs) in the borehole 104 or wellbore can cause additional fatigue or wear on parts of the drill string 108 that are curved or bent during rotation. Doglegs can, for example, cause the drill string components to impart a significantly higher sideload at those points, which in turn may cause mechanical wear. Drill string components subjected to rotation while in a non-rectilinear disposition are therefore subjected to greater wear, which may increase the risk of washouts or other catastrophic failure of the drill string 108. Cased borehole sections located in a curved portion (such as the example curved portion 105 of FIG. 1) are exposed to higher rates of wear of both the casing and the drill pipe. This can negatively affect the long-term structural or pressure integrity of the casing, which may call for remedial cementation or casing to patch worn sections. A universal reduction in the drill string speed, however, is not feasible, because lower speeds of rotation can cause other problems in certain parts of the drill string 108. Relatively high rotational speeds are desirable in some parts of the drill string 108, for example, to assist cuttings agitation and transportation, particularly in high-angled boreholes 104.

These problems can beneficially be ameliorated by controlled engagement and/or disengagement of the pair of gearboxes 160 to rotate the intermediate portion 163 at a lower speed, when desired. When the intermediate portion 163 is wholly located above the curved portion 105, the upper gearbox 160*a* and the lower gearbox 160*b* may be disposed to the disengaged mode, so that torque and rotation are transmitted along the intermediate portion 163 at the same speed as portions of the drill string 108 immediately above and below it.

When, however, the intermediate portion 163 enters the curved portion 105 of the borehole 104, both of the gearboxes 160 may be switched to the engaged mode, so that the upper gearbox 160*a* decreases the drill string speed, while the oppositely oriented lower gearbox 160*b* inversely increases the drill string speed. This has the result that BHA 151 (and any other components downhole of the lower gearbox 160*b* in cases where the lower gearbox 160*b* is spaced from the BHA 151) is rotated at the same speed as that applied to the drill string 108 by surface equipment at the drilling platform 112. Once the drill string 108 has migrated sufficiently downhole so that the upper gearbox 160*a* is located downhole of the bottom end of the curved portion 105, the pair of gearboxes 160 may both again be switched to the disengaged mode, so that the intermediate portion 163 again rotates in unison with the remainder of the drill string 108.

It will be appreciated that multiple gearboxes 160 may be incorporated in the drill string 108 in respective pairs that are spaced apart a distance greater than the length of the curved portion 105. The various gearboxes 160 may, in such a case, be engaged and/or disengaged as the respective intermediate portions 163 pass the curved portion 105 of the drill string 108, so that the rotational speed of the drill string 108 in the curved portion 105 is continuously maintained at a lower rotational speed than remaining parts of the drill string 108 above and below the curved portion 105.

Figure 6:
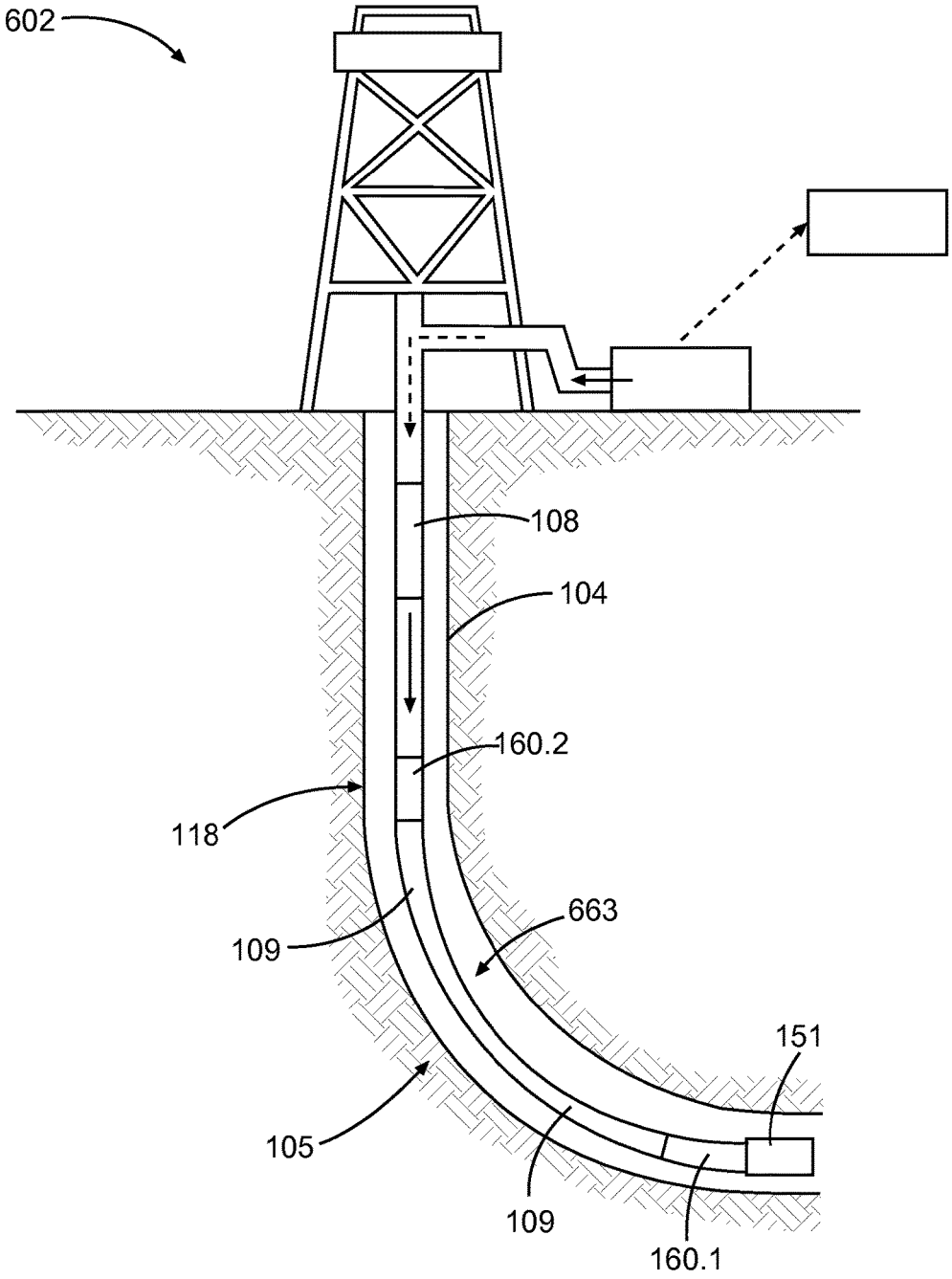
FIG. 6 depicts a schematic elevational diagram of a drilling system in accordance with another example embodiment, the drilling system including a drill string having a number of identically oriented transmission modifier devices spaced along the drill string, to allow selective rotation of drill string components downhole of a curved portion of a borehole at a lower speed than drill string components in the curved portion and uphole thereof.
Figure 7:
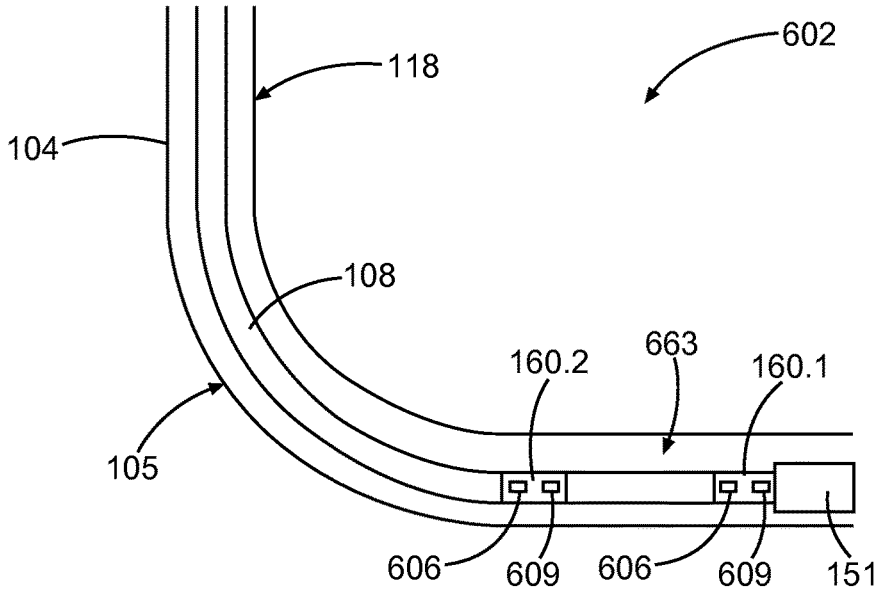
FIG. 7 depicts a view corresponding to FIG. 6, with the example drill string having been migrated further downhole than is the case in FIG. 6.

FIGS. 6 and 7 show another example embodiment of a method of using the example transmission modifier devices according to one aspect of the disclosure, as well as showing another example embodiment of a drilling installation 602 in accordance with the disclosure. In the embodiment of FIG. 6, the drill string 108 includes a lower gearbox 160.1 located immediately behind the BHA 151, and an upper gearbox 160.2 spaced from the lower gearbox 160.1 by multiple drill string section lengths to define an intermediate portion 663 between them. In the embodiment of FIG. 6, the gearboxes 160.1, on 160.2 have identical orientations, in this example embodiment being oriented for step-up speed modification. Referring briefly again to FIG. 2A, each one of the gearboxes 160 in FIG. 6 may have its planet gear carrier shaft 205 located at the uphole end of the respective device.

Initially, both of the gearboxes 160 can be disengaged, with the drill string 108 rotating at a universal speed. During such initial unified rotation of the drill string 108, surface rotation may be applied to the drill string 108 at a relatively high speed. When the drill string 108, however, is in the position shown in FIG. 6, the BHA 151 has drilled through the curved portion 105 and is now placed in a horizontal section of the borehole 104. A reduced surface rotational speed may now be appropriate, to protect against wear on the drill string 108 and casing in the curved portion 105. This reduced rotational speed, however, may be smaller than that which is suitable for hole cleaning in the fully horizontal section of the borehole 104. Greater rotational speed is thus suitable for the horizontal section than that which is supplied from the surface. At this stage, the lower gearbox 160.1 may be switched to the engaged mode. The lowered rotational speed received from the surface through the drill string 108 to protect the casing is now increased by the lower gearbox 160.1. This achieves rotation of the BHA 151 at a higher rotational speed, so that the BHA 151 rotates at a speed sufficiently high to agitate rock cuttings into the fluid flow path of the annulus 134 for transport out of the borehole 104. At this stage of the operation, the upper gearbox 160.2 is in the disengaged mode, and does not modify the rotational speed of the drill string 108's drill pipe.

When the drill string 108 is in the condition shown in FIG. 7, an extended horizontal section of the borehole 104 has been drilled, and the upper gearbox 160.2 is located below the curved portion 105 of the borehole 104. At this stage, an operator may switch the upper gearbox 160.2 to the engaged mode, to increase rotational speed below the upper gearbox 160.2. The lower gearbox 160.1 can now be disengaged, as all drill string components below the upper gearbox 160.2 (including the BHA 151 and the lower gearbox 160.1) are rotated at the higher rotational speed driven from the upper gearbox 160.2. Although only two gearboxes 160 are shown in the example embodiment of FIGS. 6 and 7, the described principles of operation can be extended to be used with any number of gearboxes 160. The drill string 108 may thus have multiple gearboxes 160 spaced apart along the drill string 108, e.g., at regular intervals. Each one of the gearboxes 160 will then be engaged when it reaches the bottom end of the curved portion 105, and will be in the disengaged mode when it is above the curved portion 105 and when another uphole gearbox 160 closer to the curved portion 105 is in the engaged mode. In one embodiment, the intervals between successive gearboxes 160 may correspond to or be somewhat larger than the length of the curved portion 105 that is to be negotiated.

As illustrated schematically in FIG. 7, the gearboxes 160 may include one or more telemetry devices in the example form of rotation sensors to measure input and output speeds of the relevant gearbox 160, and to communicate the measured input and output speeds to a control arrangement 167 (e.g., to the measurement and control assembly 120). Each example transmission modifier device in the embodiment of FIGS. 6 and 7 therefore includes an input revolutions per minute (rpm) sensor 606 and an output rpm sensor 609. These sensors 606, 609 may be communicatively coupled to the control arrangement 167 (not shown in FIG. 7, for clarity of illustration), which may include a signal transmitter for communication with, e.g., the BHA 151 or the surface control system 140. Note that the telemetry devices discussed above (as well as a mode sensor 808, as described with reference to FIG. 8 below) are also provided in the example gearboxes 160 described with reference to FIGS. 1-5.

Figure 8:
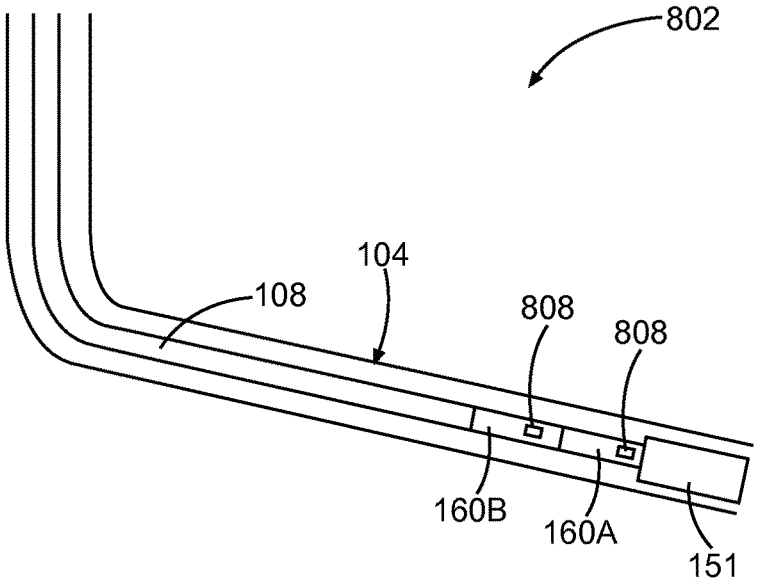
FIG. 8 depicts a schematic elevational diagram of a drilling system in accordance with yet a further example embodiment, the drilling system including a pair of the example transmission modifier devices incorporated in a drill string immediately uphole of a bottom hole assembly that includes a drill bit.

In other embodiments, transmission modifier devices can be used to step-down the speed of drill string rotation, if rotational speed is limited by functional requirements of another drill string component. An example of such a method will be described with reference to FIG. 8, which shows a drilling system 802 in accordance with another example embodiment. In a drilling operation performed by the drilling system 802 of FIG. 8, there is a need to perform rotation at higher speeds throughout an upper section of the drill string 108 (the "upper section" in this instance being that part of the drill string 108 located uphole of a pair of transmission modifier devices in the example form of gearboxes 160A and 160B). However, parts of the BHA 151 have an upper operational speed limit at which they can safely be operated. In this example, the upper section is rotated at a relatively high rotational speed, which is higher than the speed limits of some lower components forming part of the BHA 151. The pair of gearboxes 160 in the example embodiment of FIG. 8 are connected together end-to-end immediately uphole of the BHA 151. At least one of the gearboxes 160A, 160B may be selectively engaged by an operator to reduce the speed of rotation received from the upper section of the drill string 108 to a speed that is within the operational range of the lower components.

As indicated schematically by reference numeral 808, each gearbox 160 in FIG. 8 comprises a further telemetry device (in addition to or, in some embodiments, instead of the control arrangement 167 and/or the rotation sensors 606, 609) in the form of a mode sensor 808 to sense and communicate a current engagement mode of the respective gearbox 160 to an offboard receiver, e.g. forming part of the BHA 151.

As illustrated in the example embodiment of FIG. 8, some example embodiments comprise connecting together a number of transmission modifier devices, e.g. the gearboxes 160, if speed modification at a ratio greater than that provided by a single one of the transmission modifier devices 160 is to be used. In this example, a pair of devices are connected together in step-down orientation. If a 2.5:1 speed reduction is desired, only one of the pair of devices 160 are engaged, while both of the devices 116 may be engaged in combination to provide a speed reduction ratio of 5:1. It will be appreciated that any number of devices 116 may be connected together in combination to provide a desired speed transformation ratio. Such a composite transmission modifier assembly may be oriented either to provide step-up transformation, or to provide step-down transformation (as is the case in the example embodiment of FIG. 8). The example gearboxes 160 thus provide modular speed modification units that can be connected anywhere in the drill string 108, and in any combination with other similar gearboxes 160, to modify operational rotational speed and torque of the drill pipe wall a downhole thereof. Because the connection formations 209 (e.g., FIG. 2) of the gearboxes 16 and are compatible with the connection formations 209 of drill pipe sections 109, tools subs, controls subs, the BHA 151, and the like, as well as being compatible with other similar gearboxes 160, rotational speed behavior of different portions of the drill string 108 can be customized dynamically and on-the-fly by inserting the gearboxes 160 at desired locations in the drill string 108 at the drilling platform 112.

Some aspects of the disclosed subject matter realized by the above-described example embodiments thus include a method for independently modifying a rotary speed for a drill string portion. The modified-speed drill string portion is thus rotated at a different speed from other parts of the drill string. In one aspect, the method comprises: selectively transmitting torque and rotation along a drill string that extends within a borehole and comprises multiple drill string sections connected end-to-end; incorporating a pair of transmission modifier devices at longitudinally spaced positions in the drill string such that an intermediate portion defined between the pair of transmission modifier devices comprises multiple drill string sections; using each transmission modifier device to transmit drill string torque and rotation between adjacent drill string sections at opposite ends of the respective transmission modifier device; and selectively switching each transmission modifier device between (a) a disengaged mode in which the transmission modifier device transmits the drill string torque and rotation substantially unchanged, and (b) an engaged mode in which the transmission modifier device modifies the drill string torque and rotation during transmission, to deliver output rotation at a modified output speed.

The method may further comprise disposing the pair of transmission modifier devices in respective engagement modes such that a curved portion of the drill string rotates at a lower speed than a substantially rectilinear portion of the drill string. At least a portion of the drill string below the curved portion may thus rotate at a higher speed than the intermediate portion. In some embodiments, both a portion of the drill string above the curved portion and a portion of the drill string below the curved portion may be rotated at an elevated rotary speed relative to the curved portion.

The method may include switching a first one of the pair of transmission modifier devices to the engaged mode when the first transmission modifier device is located at or adjacent a particular point in the borehole, a second one of the pair of transmission modifier devices being in the disengaged mode, thereby causing rotation of a portion of the drill string located downhole of the first transmission modifier device at a modified speed relative to a portion of the drill string located uphole of the first transmission modifier device; and, after subsequent downhole migration of the first transmission modifier device, switching the second transmission modifier device to the engaged mode when the second transmission modifier device is located at or adjacent the particular point in the borehole, thereby causing rotation of a portion of the drill string located downhole of the second transmission modifier device at the modified speed relative to speed of rotation of a portion of the drill string located uphole of the second transmission modifier device. In such cases, the modified speed maybe higher than a surface speed at which the drill string is drivingly rotated by surface equipment.

The drill string may in some example embodiments include multiple transmission modifier devices staggered along the length of the drill string, in which case the method may include switching each transmission modifier device to the engaged mode when it reaches the particular point in the drill string, while switching each transmission modifier device back to the disengaged mode when a succeeding transmission modifier device is switched to the engaged mode. In this manner, the portion of the drill string downhole of the particular point is consistently maintained at a modified rotational speed relative to a portion of the drill string uphole of the particular point. In some embodiments, the particular point at which a series of transmission modifier devices are successively is switched to the engaged mode may be at or adjacent a downhole end of a curved portion of the borehole, in which case a substantially rectilinear portion of the drill string below the curved portion may consistently been maintained at an elevated rotary speed relative to the rotary speed of the drill string in the curved portion. Note that in such cases, the particular drill string sections that make up the respective drill string portions will change as the drill string migrates downhole (or uphole, as the case may be), but the positions relative to the borehole of the different portions rotating at different speeds are kept substantially constant due to continued switching of the respective transmission modifier devices to the engaged mode when they migrated sufficiently far downhole to become part of the drill string portion downhole of the curved portion.

The method may further comprise drivingly rotating the drill string at a baseline surface speed while neither of the pair of transmission modifier devices is in the engaged mode; and drivingly rotating the drill string at an altered surface speed, different from the baseline surface speed, while either of the pair of transmission modifier devices is in the engaged mode.

The method may further comprise disposing both of the pair of transmission modifier devices in the engaged mode. In some embodiments, one of the transmission modifier devices, when disposed in the engaged mode, decreases drill string rotational speed across it, while the other transmission modifier device of the pair, when disposed in the engaged mode, increases drill string rotational speed across it. In such cases, the intermediate portion between the pair of transmission modifier devices is selectively rotated at a drill string speed different from the remainder of the drill string, that is providing for independent rotary speed control of the intermediate portion. In other embodiments, the pair of transmission modifier devices may be oriented or configured to each increase drill string rotational speed across it, or may, instead, be oriented or configured to each decrease drill string rotational speed across it.

The method may further comprise receiving respective mode signals from the pair of transmission modifier devices, each mode signal indicating a current engagement mode of the corresponding transmission modifier device. The method may further comprise receiving at least one speed signal from each one of the pair of transmission modifier devices, each speed signal indicating a sensed rotational speed of at least one of: an input member of the corresponding transmission modifier device, and an output member of the corresponding transmission modifier device.

In some embodiments, the transmission mechanism comprises a planetary gear system drivingly interconnecting an input member and an output member of the respective transmission modifier device. In such cases, the method may further comprise (a) disposing the transmission mechanism to the engaged mode by rotationally anchoring a ring gear member of the planetary gear system to a formation through which the borehole extends, and (b) disposing the transmission mechanism to the disengaged mode by releasing rotational anchoring of the ring gear member to the formation, while rotationally keying at least a sun gear member or a planet gear carrier member to the ring gear member.

Another aspect of the disclosure of move that is realized by the above-described example embodiments includes a device for incorporation in a drill string that will comprise multiple tubular drill string sections co-axially connected together end-to-end to transmit drill string torque and rotation along the drill string, the device including, at least: (a) a tubular input member configured for coupling to a first drill string section to receive drill string torque and rotation at an input speed from the tubular drill pipe wall of the first drill string section; (b) a tubular output member configured for coupling to a second drill string section to transmit drill string torque and rotation to a tubular drill pipe wall of the second drill string section, the input member and the output member being co-axially aligned; and (c) a passive transmission mechanism coupled to the input member and the output member to transmit torque and rotation from the input member to the output member, the transmission mechanism being switchable between a disengaged mode in which the transmission mechanism is configured to deliver torque and rotation to the output member at an output speed substantially equal to the input speed, and an engaged mode in which the transmission mechanism is configured to deliver torque and rotation to the output member at a modified output speed relative to the input speed.

The input member and the output member may define respective fluid passages that are co-axially aligned and that are in fluid flow communication to define a composite fluid conduit that extends continuously through the device. The composite fluid conduit may be disposed co-axially with a longitudinal axis of the device, the composite fluid conduit having a substantially constant cross-sectional profile along its length. In such cases, the transmission mechanism may be substantially clear of the composite fluid conduit. In some embodiments, the input member and the output member may have substantially similar inner diameters and may have substantially similar outer diameters, the input member and the output member being arranged in end-to-end alignment.

The device may comprise a telemetry device to communicate a current engagement mode of the transmission mechanism to a surface receiver. Instead, or in addition, the device may include one or more rotation sensors configured to measure the respective speeds of the input member and the output member, and to communicate the measured speeds to the telemetry device and/or to a surface receiver (e.g., a computer system located at the surface).

The transmission mechanism may comprise a gear mechanism of which the input member and the output member form part. In some embodiments, the gear mechanism is a planetary gear system. The planetary gear system may comprise, at least: (a) a planet gear carrier shaft provided by one of the input member and the output member; (b) a set of planet gears mounted on the planet gear carrier shaft to rotate about respective planet gear axes spaced circumferentially about a rotational axis of the planet gear carrier shaft; (c) a sun gear shaft provided by the other one of the input member and the output member, the sun gear shaft providing an external sun gear; and (d) a generally tubular ring gear body disposed co-axially with the planet gear carrier shaft and the sun gear shaft, the ring gear body providing an internal ring gear, wherein the set of planet gears are in mesh both with the sun gear and with the ring gear, thereby to transmit torque and rotation from the planet gear carrier shaft to the sun gear shaft, or vice versa, via the set of planet gears.

The device may further comprise a switching mechanism to switch the transmission mechanism between the engaged mode and the disengaged mode, the switching mechanism comprising a locking mechanism configured to rotatably lock the ring gear body to a particular one of the planet gear carrier and sun gear shaft, thereby to cause unified rotation of the planet gear carrier shaft, the sun gear shaft, and the ring gear body. The device may further comprise a rotational anchor mechanism coupled to the ring gear body and configured for engagement, when the transmission mechanism is in the engaged mode, with a formation through which the borehole extends, to resist rotation of the ring gear body relative to the formation, the switching mechanism being configured to synchronously release the locking mechanism to permit geared rotation of both the sun gear shaft and the planet gear carrier shaft relative to the ring gear body.

The rotational anchor mechanism may comprise an anchor member rotationally keyed to the ring gear body and configured for displacement between a deployed condition in which the anchor member projects radially beyond the ring gear body and is disposed to engage the formation, and a retracted condition in which the anchor member is radially retracted relative to the deployed condition, to allow rotation of the ring gear body relative to the formation. In such cases, the switching mechanism may include a switch member configured for displacement relative to the ring gear body between an engagement position and a disengagement position, to cause displacement of the anchor member between the deployed condition and the retracted condition, the switch member further being configured to cause locking and unlocking of the locking mechanism in response to movement of the switch member between the engagement position and the disengagement position.

The device may further comprise a switching mechanism to switch the transmission mechanism between the engaged mode and the disengaged mode. In such cases, the device may yet further comprise a control arrangement coupled to the switching mechanism and configured to receive control signals while the device is incorporated in the drill string and the device is located downhole.

A further aspect of the disclosure which is realized by the above describe example embodiments include a drill string that includes two or more of the transmission modifier devices. Yet a further aspect of the disclosure comprises a drilling system that includes the drill string and a control system communicatively coupled to the respective transmission modifier devices to selectively switch the transmission modifier devices between the engaged mode and the disengaged mode.

In the foregoing Detailed Description, it can be seen that various features are grouped together in a single embodiment for the purpose of streamlining the disclosure. This method of disclosure is not to be interpreted as reflecting an intention that the claimed embodiments necessarily has more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A method comprising:

selectively transmitting torque and rotation along a drill string that extends within a borehole and comprises an uphole portion, an intermediate portion, and a downhole portion connected together;

incorporating a pair of transmission modifier devices into the drill string with the intermediate portion of the drill string therebetween;

using each transmission modifier device to transmit drill string torque and rotation between adjacent portions of the drill string at opposite ends of the respective transmission modifier device; and selectively switching each transmission modifier device between a disengaged mode and an engaged mode to either transmit the drill string torque and rotation substantially unchanged between the respective adjacent portions of the drill string or modify the drill string torque and rotation transmitted between the respective adjacent portions of the drill string such that the uphole portion, the intermediate portion, and the downhole portion may each rotate at different speeds.

2. The method of claim 1, further comprising disposing the pair of transmission modifier devices in respective engaged modes such that a curved portion of the drill string rotates at a lower speed than a substantially rectilinear portion of the drill string.

3. The method of claim 1, further comprising:

switching a first one of the pair of transmission modifier devices to the engaged mode when the first transmission modifier device is located at or adjacent a particular point in the borehole, a second one of the pair of transmission modifier devices being in the disengaged mode, thereby causing rotation of a portion of the drill string located downhole of the first transmission modifier device at a modified speed relative to a portion of the drill string located uphole of the first transmission modifier device; and after subsequent downhole migration of the first transmission modifier device, switching the second transmission modifier device to the engaged mode when the second transmission modifier device is located at or adjacent the particular point in the borehole, thereby causing rotation of a portion of the drill string located downhole of the second transmission modifier device at the modified speed relative to speed of rotation of a portion of the drill string located uphole of the second transmission modifier device.

4. The method of claim 3, wherein the modified speed is higher than a surface speed at which the drill string is drivingly rotated by surface equipment.

5. The method of claim 3, further comprising:

drivingly rotating the drill string at a baseline surface speed while neither of the pair of transmission modifier devices is in the engaged mode; and drivingly rotating the drill string at an altered surface speed, different from the baseline surface speed, while either of the pair of transmission modifier devices is in the engaged mode.

6. The method of claim 3, wherein the particular point of the borehole is positioned at or adjacent a downhole end of a curved portion of the borehole.

7. The method of claim 1, further comprising disposing both of the pair of transmission modifier devices in the engaged mode.

8. The method of claim 7, wherein a first one of the transmission modifier devices, when disposed in the engaged mode, decreases drill string rotational speed across the first transmission modifier device, a second one of the transmission modifier devices of the pair, when disposed in the engaged mode, increases drill string rotational speed across the second one of the transmission modifier devices.

9. The method of claim 1, further comprising receiving respective mode signals from the pair of transmission modifier devices, each mode signal indicating a current engagement mode of a corresponding transmission modifier device.

10. The method of claim 1, further comprising receiving at least one speed signal from each one of the pair of transmission modifier devices, each speed signal indicating a sensed rotational speed of at least one of: an input member of a corresponding transmission modifier device, and an output member of the corresponding transmission modifier device.

11. The method of claim 1, wherein each transmission modifier device includes a transmission mechanism comprising a planetary gear system drivingly interconnecting an input member and an output member of a respective transmission modifier device, the method further comprising:

disposing the transmission mechanism to the engaged mode by rotationally anchoring a ring gear member of the planetary gear system to a formation through which the borehole extends; and disposing the transmission mechanism to the disengaged mode by releasing rotational anchoring of the ring gear member to the formation, while rotationally keying at least a sun gear member or a planet gear carrier member to the ring gear member.

12. A device for incorporation in a drill string that comprises multiple tubular drill string sections co-axially connected together to transmit drill string torque and rotation along the drill string, the device including:

a tubular input member configured to receive drill string torque and rotation at an input speed from a tubular drill pipe wall of an uphole portion of the drill string;

a tubular output member configured to transmit drill string torque and rotation to a tubular drill pipe wall of a downhole portion of the drill string;

a tubular intermediate member positioned between the tubular input member and the tubular output member; and a pair of passive transmission mechanisms, with a first one of the pair of passive transmission mechanisms coupled to the tubular input member and the tubular intermediate member, and a second one of the pair of passive transmission mechanisms is coupled to the tubular intermediate member and the tubular output member to transmit torque and rotation between adjacent tubular members at opposite ends of the respective passive transmission mechanism, each of the pair of passive transmission mechanisms being switchable between a disengaged mode in which the respective transmission mechanism is configured to deliver torque and rotation substantially unchanged between adjacent tubular members, and an engaged mode in which the respective transmission mechanism is configured to deliver torque and rotation at a modified output speed relative to the input speed between the adjacent tubular members such that the tubular input member, the tubular output member, and the tubular intermediate member may each rotate at different speeds.

13. The device of claim 12, wherein the input member, the tubular intermediate member, and the output member define respective fluid passages that are co-axially aligned and that are in fluid flow communication to define a composite fluid conduit that extends continuously through the device.

14. The device of claim 12, wherein each of the pair of transmission mechanisms comprise a gear mechanism.

15. The device of claim 14, wherein the gear mechanism comprises a planetary gear system.

16. The device of claim 15, wherein the planetary gear system comprises:

a planet gear carrier shaft provided by one of the tubular members;

a set of planet gears mounted on the planet gear carrier shaft to rotate about respective planet gear axes spaced circumferentially about a rotational axis of the planet gear carrier shaft;

a sun gear shaft provided by another one of the tubular members, the sun gear shaft providing an external sun gear; and a generally tubular ring gear body disposed co-axially with the planet gear carrier shaft and the sun gear shaft, the ring gear body providing an internal ring gear, wherein the set of planet gears are in mesh both with the sun gear and with the ring gear, thereby to transmit torque and rotation from the planet gear carrier shaft to the sun gear shaft, or vice versa, via the set of planet gears.

17. The device of claim 16, further comprising a switching mechanism to switch one of the pair of transmission mechanisms between the engaged mode and the disengaged mode, the switching mechanism comprising a locking mechanism configured to rotatably lock the ring gear body to a particular one of the planet gear carrier and sun gear shaft, thereby to cause unified rotation of the planet gear carrier shaft, the sun gear shaft, and the ring gear body.

18. The device of claim 17, further comprising a rotational anchor mechanism coupled to the ring gear body and configured for engagement, when the one of the pair of transmission mechanisms is in the engaged mode, with a formation through which the borehole extends, to resist rotation of the ring gear body relative to the formation, the switching mechanism being configured to synchronously release the locking mechanism to permit geared rotation of both the sun gear shaft and the planet gear carrier shaft relative to the ring gear body.

19. The device of claim 18, wherein the rotational anchor mechanism comprises an anchor member rotationally keyed to the ring gear body and configured for displacement between a deployed condition in which the anchor member projects radially beyond the ring gear body and is disposed to engage the formation, and a retracted condition in which the anchor member is radially retracted relative to the deployed condition, to allow rotation of the ring gear body relative to the formation.

20. The device of claim 19, wherein in the switching mechanism includes a switch member configured for displacement relative to the ring gear body between an engagement position and a disengagement position, to cause displacement of the anchor member between the deployed condition and the retracted condition, the switch member further being configured to cause locking and unlocking of the locking mechanism in response to movement of the switch member between the engagement position and the disengagement position.

21. The device of claim 12, further comprising:

a switching mechanism to switch one of the pair of transmission mechanisms between the engaged mode and the disengaged mode; and a control arrangement coupled to the switching mechanism and configured to receive control signals while the device is incorporated in the drill string and the device is located downhole.

22. The device of claim 12, further comprising a telemetry device to communicate a current engaged mode of the one of the pair of transmission mechanisms to a surface receiver.

* * * * *